US010179678B2

(12) United States Patent
Oliveira et al.

(10) Patent No.: US 10,179,678 B2
(45) Date of Patent: Jan. 15, 2019

(54) APPLICATOR WITH BREAKAWAY CAP

(71) Applicant: The Hartz Mountain Corporation, Secaucus, NJ (US)

(72) Inventors: Vitor Oliveira, Elizabeth, NJ (US); Takeshi Ikegami, Fort Lee, NJ (US)

(73) Assignee: THE HARTZ MOUNTAIN CORPORATION, Secaucus, NJ (US)

( * ) Notice: Subject to any disclaimer, the term of this patent is extended or adjusted under 35 U.S.C. 154(b) by 4 days.

(21) Appl. No.: 15/497,950

(22) Filed: Apr. 26, 2017

(65) Prior Publication Data

US 2018/0312309 A1 Nov. 1, 2018

(51) Int. Cl.
*B65D 47/10* (2006.01)
*B65D 1/09* (2006.01)
*B65D 1/02* (2006.01)

(52) U.S. Cl.
CPC ..... *B65D 47/106* (2013.01); *B65D 1/0238* (2013.01); *B65D 1/095* (2013.01)

(58) Field of Classification Search
CPC .... B65D 47/10; B65D 47/106; B65D 1/0238; B65D 1/095
See application file for complete search history.

(56) References Cited

U.S. PATENT DOCUMENTS 572,327 A * 12/1896 Bryan ..... B65D 49/12 215/53
D92,135 S * 5/1934 Johnson ..... D9/697
2,049,973 A * 8/1936 Nesmith ..... B43M 11/06 401/261
2,103,389 A * 12/1937 Salfisberg ..... B65D 75/5811 156/183
2,112,085 A * 3/1938 Fridén ..... B21C 23/03 222/541.6
2,125,784 A * 8/1938 Higgins ..... A47F 5/112 248/109
2,197,579 A * 4/1940 Hooper ..... B65D 35/38 222/562
2,394,135 A 2/1946 Barr
2,552,100 A * 5/1951 Leonetti ..... A61M 5/28 604/192
2,663,461 A * 12/1953 Brown ..... A61J 1/067 206/820
2,750,068 A * 6/1956 Platt, Jr. ..... B65D 47/10 220/265

(Continued)

OTHER PUBLICATIONS

International Search Report and Written Opinion, United States Patent and Trademark Office, Application No. PCT/US2018/028891, dated Jul. 12, 2018.

*Primary Examiner* — Paul R Durand
*Assistant Examiner* — Randall A Gruby
(74) *Attorney, Agent, or Firm* — Gottlieb, Rackman & Reisman, P.C.

(57) ABSTRACT

An applicator assembly, a method of assembly of the applicator and a method of use of the applicator. The applicator assembly includes a reservoir body, a neck that extends from the reservoir body and includes an exposable opening at a distal end thereof and a shroud that extends from the distal end about the exposable opening and a cap that is integrally formed with and releasably fixed to the distal end of the neck, fully encompassing the opening in the neck and sealing the reservoir body.

30 Claims, 12 Drawing Sheets

(56) References Cited

U.S. PATENT DOCUMENTS 2,802,605 A * 8/1957 Parker ..... B01L 3/0282 222/215
2,815,150 A * 12/1957 Herzig ..... B65D 47/2037 222/211
2,930,063 A * 3/1960 Stull ..... B65D 35/36 215/228
2,952,861 A * 9/1960 Reggio ..... B65D 47/42 222/541.2
3,114,369 A * 12/1963 Hall ..... A61J 1/067 604/192
3,128,920 A * 4/1964 Volckening et al. .. B65D 75/48 206/484
3,187,966 A * 6/1965 Klygis ..... B65D 1/0238 215/48
3,199,748 A * 8/1965 Bross ..... B65D 47/10 215/307
3,204,835 A * 9/1965 Kenneth ..... B65D 1/0238 215/43
3,359,602 A * 12/1967 Bailey ..... B29C 49/48 264/525
3,416,712 A * 12/1968 Shastal ..... B65D 47/10 215/48
3,460,724 A * 8/1969 Chmela ..... B65D 47/36 222/541.5
3,754,710 A 8/1973 Chimura
3,777,949 A * 12/1973 Chiquiari-Arias ..... B65D 1/095 222/541.8
3,858,739 A * 1/1975 Turner ..... B65D 1/08 215/47
4,087,022 A * 5/1978 Zanetti-Streccia ..... B05B 11/3001 222/183
4,207,990 A * 6/1980 Weiler ..... A61J 1/1406 215/375
4,248,227 A 2/1981 Thomas
4,266,681 A * 5/1981 Fredericks ..... A61J 1/065 215/47
4,284,199 A * 8/1981 Bigarella ..... B65D 47/103 215/47
4,410,096 A * 10/1983 Paradis ..... B29C 45/006 215/50
4,512,475 A * 4/1985 Federighi ..... A61J 1/067 206/484
4,618,101 A 10/1986 Piggott
4,671,763 A * 6/1987 Weiler ..... B29C 49/42 264/524
4,688,703 A * 8/1987 Bayer ..... B65D 35/44 215/215
4,765,518 A 8/1988 O'Meara
4,926,915 A * 5/1990 Deussen ..... A61J 1/067 141/18
5,076,452 A 12/1991 Hashimoto
5,121,856 A * 6/1992 Weiler ..... A61M 31/00 222/209
5,221,029 A 6/1993 Stull
5,225,804 A 10/1993 Butterbrodt
5,255,804 A * 10/1993 Butterbrodt ..... B65D 1/0238 215/226
5,361,947 A * 11/1994 Lifshey ..... B65D 47/10 206/532
5,531,707 A * 7/1996 Kers ..... A61M 31/00 222/541.6
5,845,811 A * 12/1998 Shervington ..... F17C 7/00 222/3
5,897,009 A * 4/1999 O'Meara ..... B65D 47/10 215/253
D411,801 S 7/1999 Kinneir et al.
6,074,705 A 6/2000 DeBaene
D454,496 S 3/2002 Mast et al.
6,382,438 B1 * 5/2002 Schneider ..... B29C 45/006 215/250
6,422,866 B2 * 7/2002 Dragan ..... B05C 17/00593 215/252
D462,268 S 9/2002 Schroeder et al.
6,543,655 B1 * 4/2003 de Laforcade ..... B65D 47/36 222/541.9
6,619,516 B2 * 9/2003 Weiler ..... B65D 1/0238 222/420
6,712,293 B2 3/2004 Swan
6,722,532 B2 4/2004 Lasserre et al.
D494,865 S * 8/2004 Taylor ..... D9/434
6,976,578 B1 12/2005 Kenihan
D523,519 S 6/2006 Katz et al.
D524,639 S 7/2006 Paas et al.
D524,640 S 7/2006 Paas et al.
7,128,283 B1 10/2006 Shahin
D532,295 S * 11/2006 Stull ..... D9/435
D538,650 S 3/2007 Paas et al.
D544,958 S * 6/2007 Wurtz ..... D24/115
D552,485 S 10/2007 Grabiner et al.
D568,439 S 5/2008 Fulkerson et al.
7,367,518 B2 5/2008 Tanigaki et al.
D598,746 S 8/2009 Caldwell
7,614,514 B2 * 11/2009 Fuchs ..... B65D 35/44 215/256
7,695,209 B2 * 4/2010 Perignon ..... B65D 51/32 401/126
D627,224 S 11/2010 Bass et al.
7,891,529 B2 2/2011 Paas et al.
8,038,668 B2 10/2011 Scott et al.
8,464,679 B2 6/2013 Permuy et al.
8,522,994 B2 * 9/2013 Weiler ..... B65D 1/095 215/256
8,668,400 B2 * 3/2014 Ecker ..... A01K 13/002 119/603
8,690,013 B2 * 4/2014 Kneer ..... B65D 1/095 222/92
8,833,576 B2 * 9/2014 Fontana ..... A61J 1/067 206/530
8,991,721 B2 * 3/2015 Bedetti ..... B01J 2/16 239/429
9,221,595 B2 12/2015 Boyne
9,376,248 B2 * 6/2016 Shi ..... B65D 1/095
9,393,584 B2 * 7/2016 Lecoutre ..... B05C 1/00
2003/0127472 A1 * 7/2003 Doherty ..... B65D 1/0238 222/541.5
2004/0149774 A1 8/2004 Strong
2006/0011666 A1 1/2006 Wurtz et al.
2006/0070999 A1 * 4/2006 Stull ..... B65D 47/10 220/257.2
2007/0007370 A1 1/2007 Roman
2008/0014163 A1 * 1/2008 Grabiner ..... A61K 8/31 424/70.7
2009/0039083 A1 2/2009 Stull et al.
2009/0050649 A1 * 2/2009 Rushe ..... B65D 1/0238 222/106
2010/0032432 A1 * 2/2010 Stull, Sr. ..... B65D 47/10 220/257.1
2012/0285964 A1 * 11/2012 Weiler ..... B65D 1/095 220/276
2013/0018329 A1 1/2013 Mehta
2014/0061336 A1 3/2014 Kosaka et al.
2014/0061337 A1 3/2014 Kosaka et al.
2014/0199248 A1 7/2014 Boyne
2015/0151884 A1 * 6/2015 Wochele ..... B65D 1/323 604/403
2015/0246212 A1 9/2015 Burstein et al.

* cited by examiner

APPLICATOR WITH BREAKAWAY CAP

FIELD OF THE INVENTION

This invention relates generally to an applicator and more specifically to an applicator that includes a reservoir body and cap that is formed integral with the reservoir body and that is separable from the reservoir body to allow for a release and dispersion of contents housed within the reservoir body of the applicator.

BACKGROUND OF THE INVENTION

Applicators designed for various purposes to deliver liquid, gel, or the like are well known. Such applicators typically include a housing (i.e., a tube or reservoir body) that has at least an opening formed in one end thereof and a cap that can be secured to the housing to seal the opening by screwing, snapping or sliding the cap over an end of the housing with the opening formed therein to seal the applicator. Alternatively, known applicators may include a cap that is permanently fixed to a body of the applicator to aid in dispensing contents housed therein by depressing the cap and/or articulating the cap.

However, the designs of many existing applicators have several drawbacks. For example, known applicators allow for potential leakage and/or contamination and/or evaporation of the contents stored within the housing of an applicator, do not allow for a direct application of the contents housed within the applicator at a desired contact site, and/or are cumbersome to use. Additionally, many known applicator designs do not allow for all measured contents to be released from the housing. Commonly, this occurs because surfaces within the housing of the applicator are angled, prohibiting all of the contents stored therein from being dispensed therefrom. For example, at least one cavity may be formed upon puncturing the housing to create an opening or unsealing an opening formed in the body of a housing of an applicator, which in turn can result in trapping fluid within the body of the housing. It is important in many instances that all of the contents within the housing be dispensed therefrom. In the case of an animal, applicators regularly house a specific amount of medicament to apply as a measured dosage onto the skin of an animal and it is important that the full measured dosage is applied to the animal to ensure the medicament works as intended.

Additionally, for existing applicators in which a cap or other covering element must be broken (e.g., snapped) or cut to disassociate the cap or other covering element from the reservoir body, a region of the applicator where the cap or other covering element has been removed regularly forms a sharp edge. When the applicator comes in contact, as is commonly the case, with a surface (e.g., the skin of an animal), the sharp edge can cause damage or harm to the surface (e.g., irritate or cut the skin of an animal).

Further, in many instances, due to the design of a cap or other covering element for known applicators, when the cap or other covering element is removed or separated from a housing, the contents housed within the applicator can unexpectedly be dispensed from the applicator and can contact an undesired surface (e.g., hands of a human).

SUMMARY OF THE INVENTION

The present invention is directed to an applicator assembly that includes a body and a cap that is integrally formed therewith. The cap is configured to be articulated, levered, pulled and/or twisted to permanently separate the cap from the body and to allow contents (e.g., fluid) to be dispensed from the applicator directly onto a surface (e.g., the skin of an animal). The one-piece design reduces manufacturing cost by producing the applicator as a single, molded element that does not require assembly while ensuring the contents housed within the applicator remain in an air-tight, sealed reservoir until the cap is separated from the body of the applicator.

In an embodiment, the present invention is directed to an applicator that comprises a reservoir body, a neck that extends from the reservoir body and includes an exposable opening at a distal end thereof and a shroud that extends from the distal end about the opening and a cap that is in fluid communication with and releasably fixed to the distal end of the neck, fully encompassing the opening in the neck and sealing the reservoir body.

In an embodiment, the reservoir body, the neck and the cap are a single element. The applicator assembly can be comprised entirely from a polymeric material. At least the reservoir body can include a non-slip coating and be comprised of a flexible material.

The cap can include a projection that extends from the neck. A handle can extend, at least in part, at an angle from the projection. The projection can be a connecting point that is substantially circular and includes an internal cavity that is aligned with the exposable opening in the neck.

The handle can extend substantially along a length of the neck. The handle can be substantially L-shaped such that the handle can include a first arm that extends substantially transverse to and from the projection and a second arm that extends at an angle from the first projection along the neck. The second arm of the handle can extend at an angle of about 90 degrees from the distal end of the neck. The handle can also include a rib that extends substantially along a surface thereof.

The projection can be a frangible port defined by a groove, a notch or an undercut that extends inwardly from an outer periphery thereof to aid in facilitating separation of the cap from the neck at a specific location to uncover the exposable opening and minimize fragmentation at the breaking point between the neck and projection when removing the cap. The frangible portion can extend at an angle from the outer periphery of the projection, can extend at least partially about the outer periphery of the projection or entirely about the outer periphery of the projection and can include a plurality of frangible portions.

In an embodiment, the frangible portion can extend about the outer periphery of the projection adjacent an outer surface of a distal end of the neck to ensure separation of the cap when removed at about the distal end of the neck. In another embodiment, the projection can include a sidewall that has a first surface and a second surface that is spaced from the first surface and substantially aligned with the exposable opening and the frangible portion can extend inwardly from the first surface toward the second surface to facilitate separation of the cap from the neck. In further embodiment, frangible portion can extend from an outer surface at a distal end of the neck toward an inner cavity of the neck and about the exposable opening. In yet a further embodiment, the frangible portion can extend from an outer surface at a distal end of the neck toward an inner cavity of the neck and about the exposable opening and the frangible portion can extend inwardly from an outer surface of the projection, adjacent the distal end of the neck to facilitate separation of the cap from the neck.

The shroud can be comprised of a plurality of protrusions that are spaced from each other and extend about an outer periphery of the neck. The shroud can include a first protrusion that extends from a first portion of an outer periphery of the neck and a second protrusion that is spaced at least by the opening in the neck from the first protrusion, extends at a second portion of an outer periphery of the neck such that the first protrusion and the second protrusion form a recessed channel at the opening to aid in dispensing the contents housed within the reservoir body and neck when the neck is in direct contact with a surface.

In another embodiment, the present invention is directed to a method of forming an applicator where the method comprises the steps of molding the applicator as a single element that includes a reservoir body, a neck that extends from a first end of the reservoir body and includes an exposable opening at a distal end thereof and a shroud that extends from the distal end about the opening and a cap that is integrally formed with and releasably fixed to the distal end of the neck, fully encompassing the opening in the neck and sealing the reservoir body, filling the applicator with a fluid and sealing a second end of the reservoir body.

In yet another embodiment, the present invention is directed to a method of using an applicator comprising the steps of providing an applicator that includes a reservoir body, a neck that extends from the reservoir body and includes an exposable opening at a distal end thereof and a shroud that extends from the distal end about the exposable opening and a cap that is integrally formed with and releasably fixed to the distal end of the neck, fully encompassing the opening in the neck and sealing the reservoir body, holding the reservoir body with a first hand, gripping the cap with a second hand and separating the cap from the neck of the applicator. The cap can be separated from the neck by at least one of rotating, levering and pulling the cap away from the neck so as to separate the cap from the applicator.

The cap can be comprised of a projection that, in an assembled state, is in fluid communication with the neck and encompasses the exposable opening in the neck, a handle that includes a first arm extending substantially transverse to and from the projection and a second arm extending at an angle from the first projection along the neck. In an embodiment, the method can further comprise the step of gripping the second arm and at least one of lifting, pulling and rotating the second arm away from the neck to permanently remove the cap from the applicator and at least one of rotating, twisting and pulling the cap to permanently remove the cap from the applicator.

The shroud can be comprised of a plurality of protrusions that are spaced from each other and extend about an outer periphery of the neck defining a channel between the protrusions in the area of the opening at the distal end of the neck, and, in an embodiment, the method can further comprise the step of contacting the tip of the applicator with a surface wherein the protrusions aid in allowing contents housed within the applicator to be released from the applicator and flow onto the surface.

DETAILED DESCRIPTION OF EMBODIMENTS OF THE INVENTION

Figure 1:
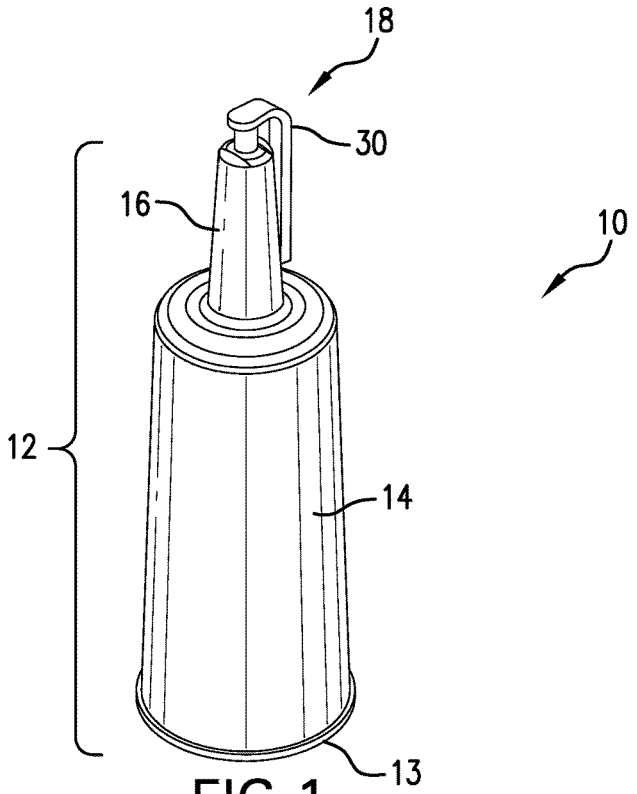
FIG. 1 is a perspective view of an embodiment of an applicator assembly.
Figure 2:
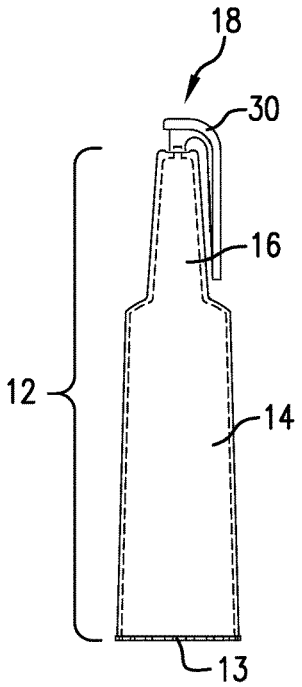
FIG. 2 is a first side view thereof.
Figure 3:
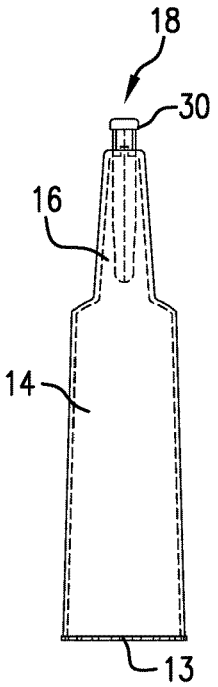
FIG. 3 is a second side view thereof.

With reference now to the drawings, and in particular to FIGS. 1-19, embodiments of applicator assemblies embodying the principles and concepts of the present invention will be described.

An embodiment of an applicator assembly, which is generally designated by reference numeral 10, is shown in FIGS. 1-5. The applicator 10 is a one-piece element that includes a reservoir body 12 that is defined by a housing 14 and a neck 16 that extends from the housing 14 and a cap 18 that is integrally formed with the reservoir body 12 and that extends from a distal end 15 (see FIG. 8) of the neck 16. After introducing contents (e.g., liquid, gel, etc.) into the reservoir body 12 during manufacturing, an end 13 of the reservoir body 12, opposite that of the distal end of the neck 16, can be heated to seal the contents within the reservoir body 12. It is noted that the size of the reservoir body 12 is not limited to a specific size, but rather can vary depending on the volume of contents desired to be housed therein.

By producing the applicator 10 assembly as a one-piece element, the manufacturing cost can be reduced as the applicator assembly 10 can be constructed in a single process, eliminating the need for additional labor to produce the applicator assembly 10 and reducing the time required to manufacture the applicator assembly 10. Additionally, by forming the applicator assembly 10 as a one-piece element, the contents housed in the applicator 10 will remain sealed within the reservoir body 12 until the cap 18 is removed, substantially eliminating the likelihood that the applicator assembly 10 will leak.

The applicator assembly 10 can be comprised of a polymeric or a plastic material, such as a polypropylene and polyethylene, that has been injection molded. The reservoir body 12 can include a non-slip coating and be comprised of a flexible material.

Figure 4:
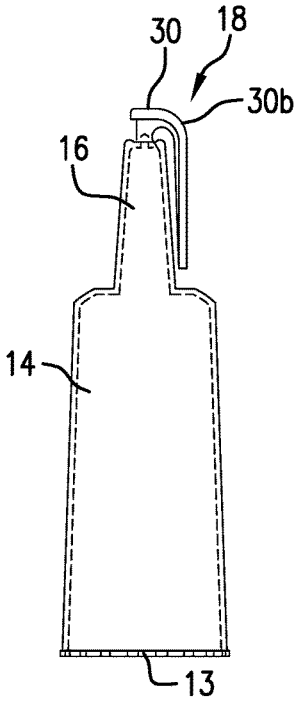
FIG. 4 is a third side view thereof.
Figure 5:
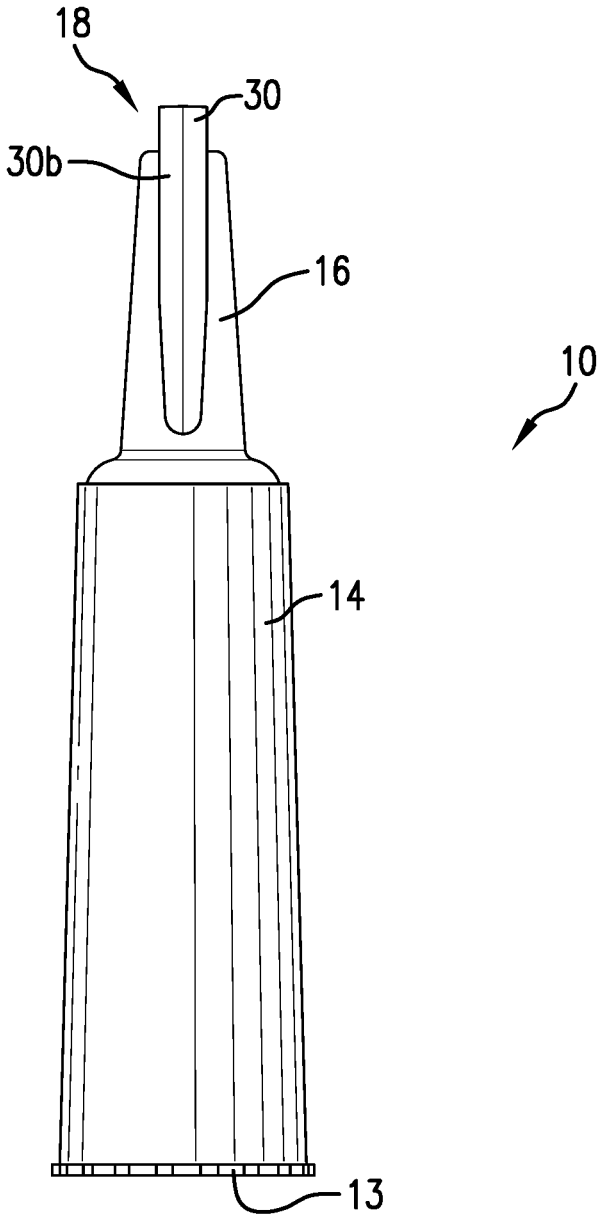
FIG. 5 is fourth side view thereof.
Figure 6:
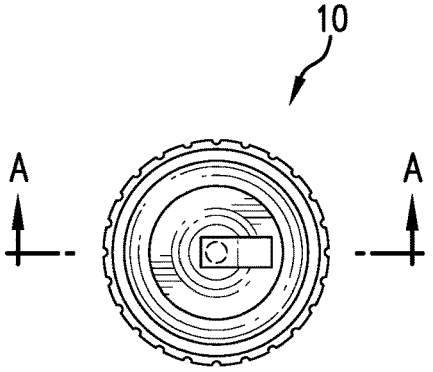
FIG. 6 is a top view thereof.
Figure 7:
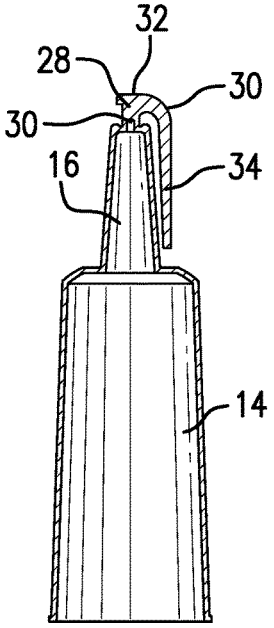
FIG. 7 is a cross-sectional view of FIG. 6 taken along line A-A.
Figure 8:
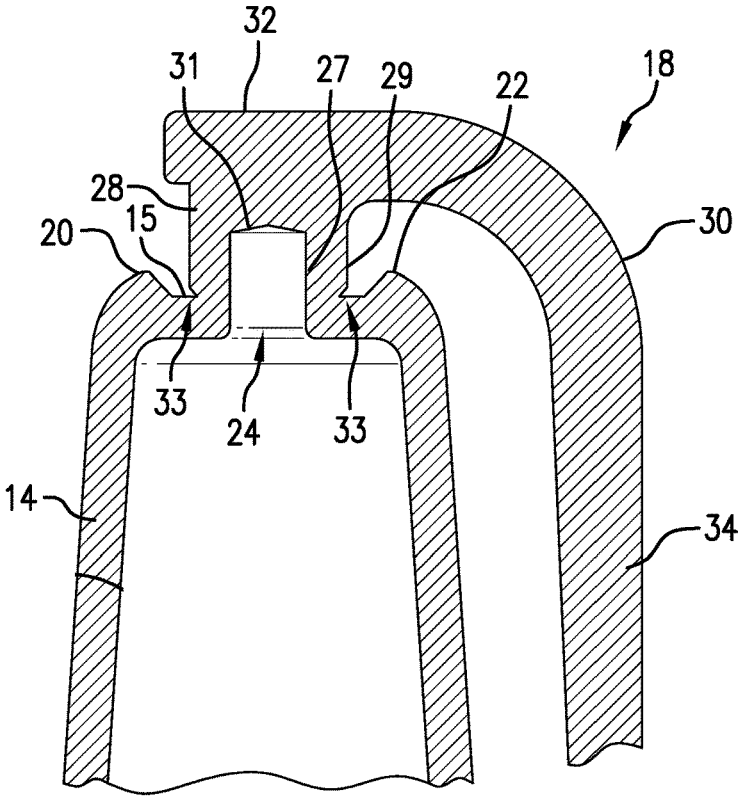
FIG. 8 is a detailed sectional view of the tip of the applicator and breakaway cap taken from FIG. 7.

FIG. 7, which is a cross-sectional view of FIG. 4 taken along line A-A of FIG. 6. FIG. 8 is a detail sectional view of FIG. 7 further depicting features of the neck 16 and the cap 18. As shown, the neck 16 includes a safety shroud that is comprised of a first projection 20 and a second projection 22 that extend from the neck 16 at a distal end 15 thereof. The first projection 20 and the second projection 22 are spaced from each other by a channel 26 (See FIGS. 17 and 18). Although two shroud projections 20, 22 are shown, it is understood that the shroud can include any number of projections that extend from the distal end of the neck 16.

When the cap 18 is removed from the neck 16, the opening 24 is exposed and a rough or jagged surface 17 (See FIGS. 16-18) is commonly formed about the periphery of the opening 24. If the distal end 15 of the neck 16 was placed in direct contact with a surface S after removal of the cap 18, such as the skin of an animal, the sharp surface 17 formed around the opening 24 can cause irritation to the skin of the animal or create a cut in the skin of the animal. However, the projections 20, 22 of the shroud, which substantially surrounds the opening 24, extends from the distal end of the neck 16 to ensure the opening 24 will not be in direct contact with an application site and prevent injury or irritation at the application site. The projections 20, 22 of the shroud also acts to create a gap between the opening 24 and the application site, to prevent the applicator 10 from becoming obstructed and allowing the contents housed in the applicator 10 to flow out of the opening 24 and to a desired contact site.

As can be seen in FIGS. 7 and 8, the cap 18 extends from the distal end 15 of the neck 16, fully encompassing the opening 24. The cap 18 includes a protrusion or connecting point 28 that has an inner surface 27 and is in fluid communication with the neck 16, fully encompassing the opening 24 of the neck 16 and preventing leakage at the opening 24, a handle 30 that is comprised of a first leg 32 which extends substantially perpendicular to the protrusion 28 and distal end 15 of the neck 16 and a second leg 34 that extends at an angle from the first leg 32 along the length of the neck 16. In an embodiment, the first leg 32 can extend at an angle of about 90 degrees from the distal end 15 of the neck 16. A rib 35 can extend along at least one of the ventral surface 30*a* and dorsal surface 30*b* of the handle 30 to provide rigidity thereto.

Figure 9:
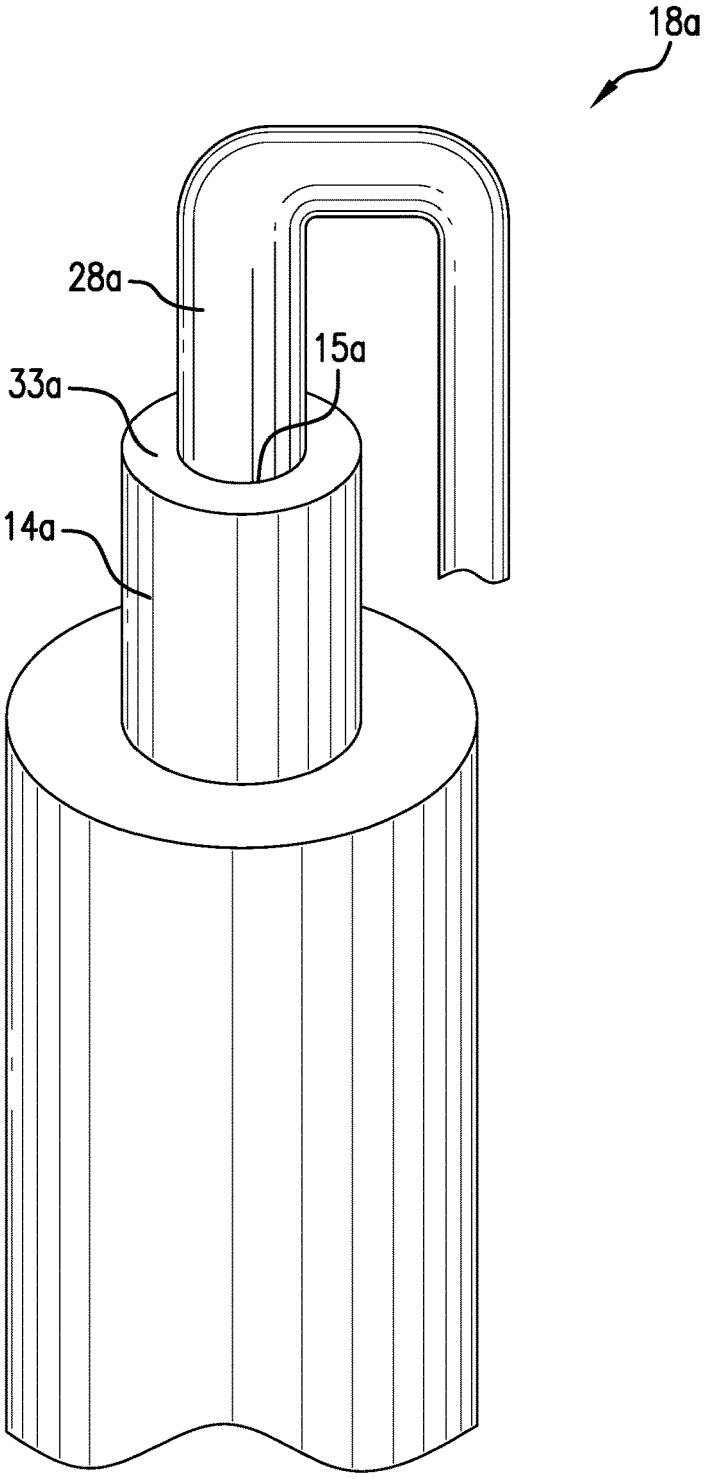
FIG. 9 is a perspective view of a second embodiment of an applicator assembly.
Figure 10:
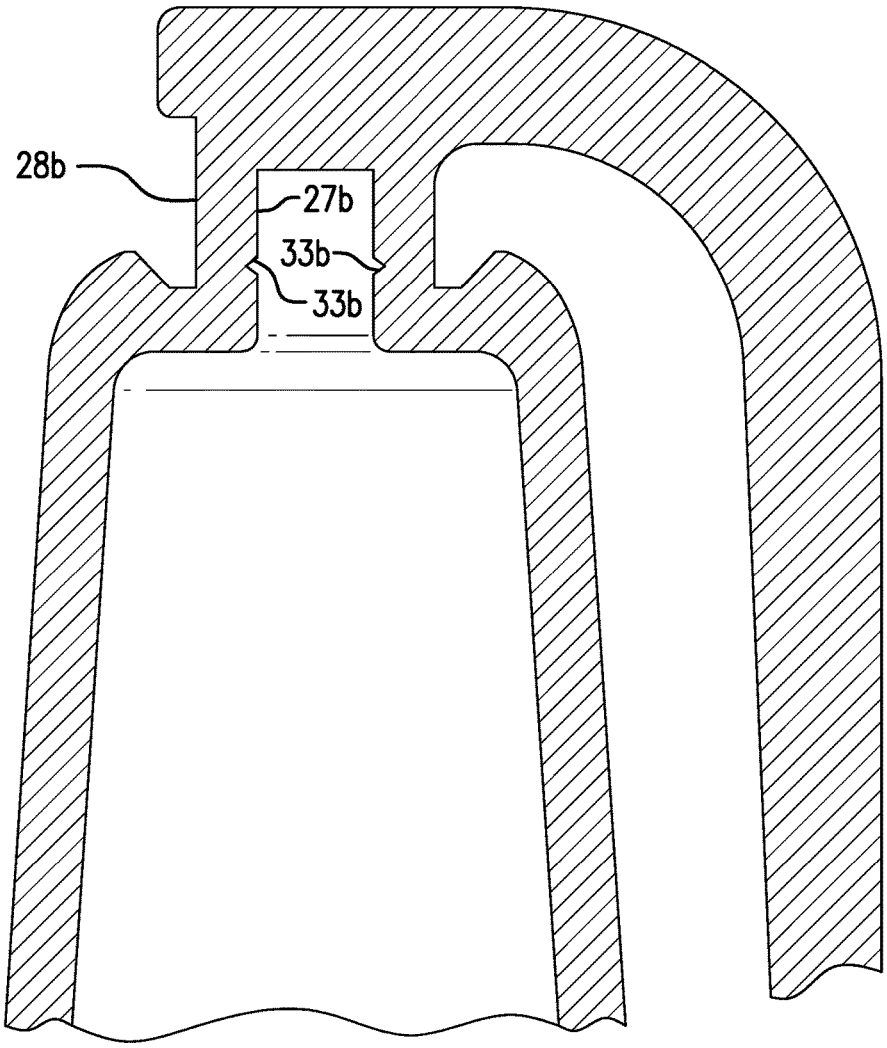
FIG. 10 is a partial cross-sectional view of a third embodiment of an applicator assembly.
Figure 11:
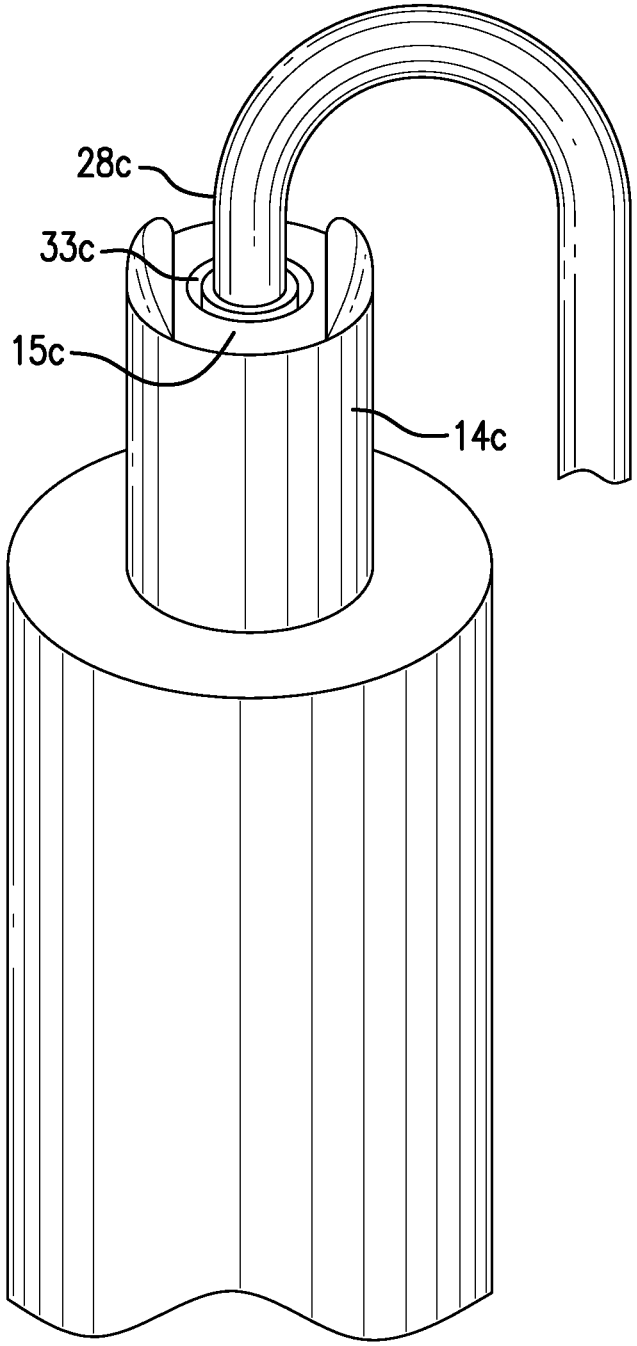
FIG. 11 is a perspective view of a fourth embodiment of an applicator assembly.
Figure 12:
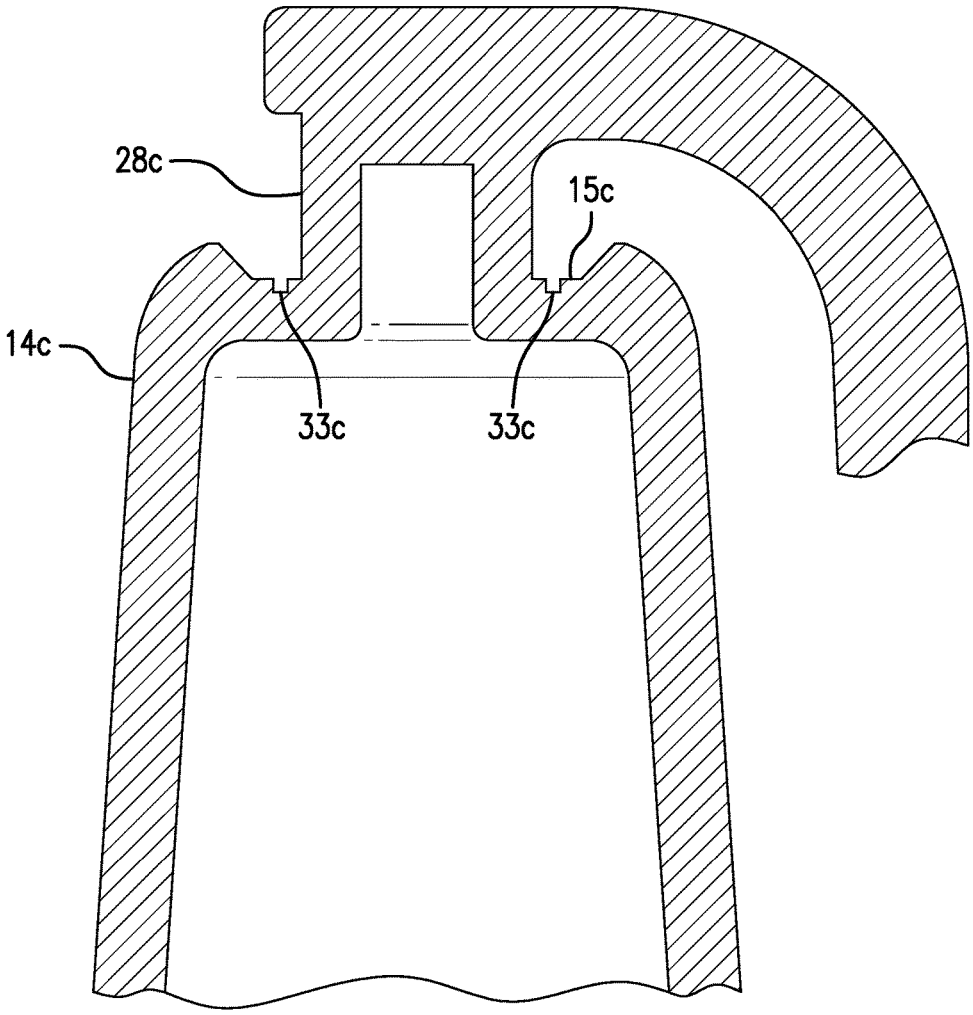
FIG. 12 is a partial cross-sectional view of the applicator assembly of FIG. 11.
Figure 13:
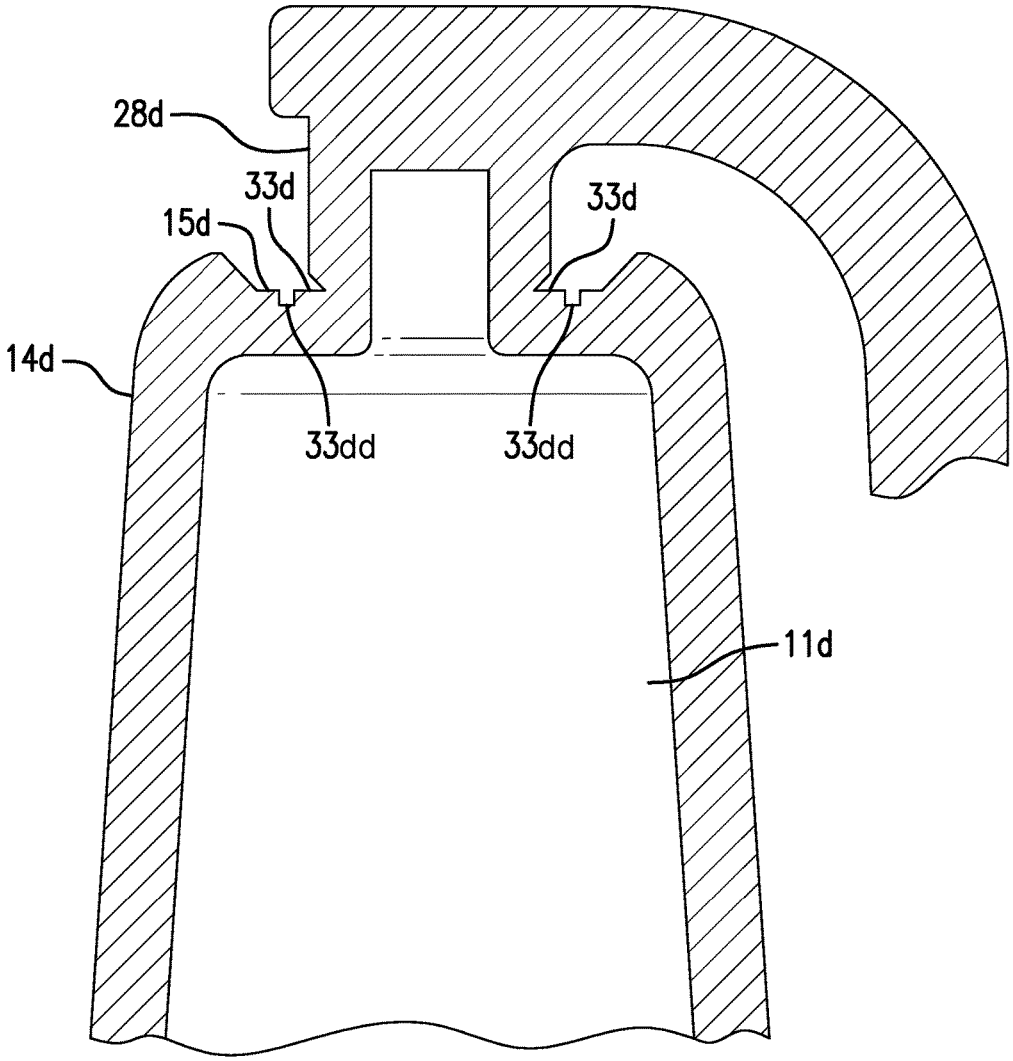
FIG. 13 is a partial cross-sectional view of a fifth embodiment of an applicator assembly.
Figure 14A:
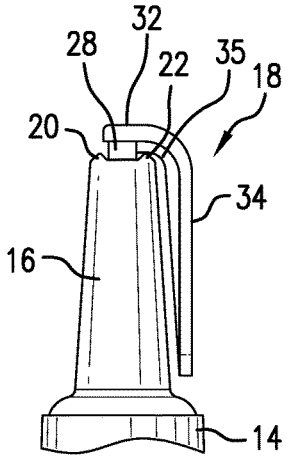
FIGS. 14A-14C sequentially show the breakaway cap in a fixed, sealed position, being articulated from the tip of the applicator and being further articulated to separate the cap from the tip.
Figure 14B:
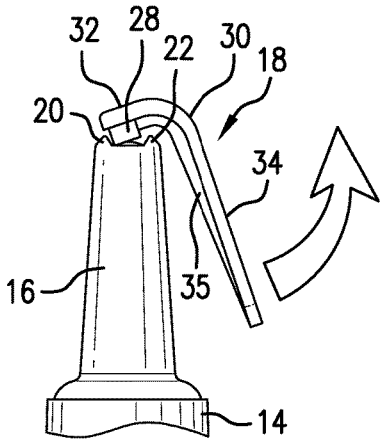
Figure 14C:
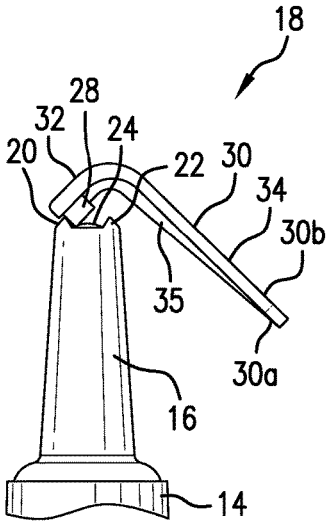
Figure 15A:
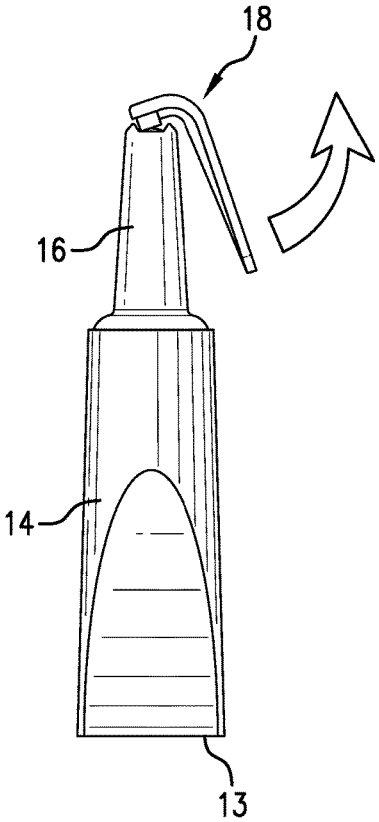
FIGS. 15A and 15B show the applicator tube in an assembled state with the breakaway being articulated from the tip of the applicator and being further articulated to separate the cap from the tip of the applicator.
Figure 15B:
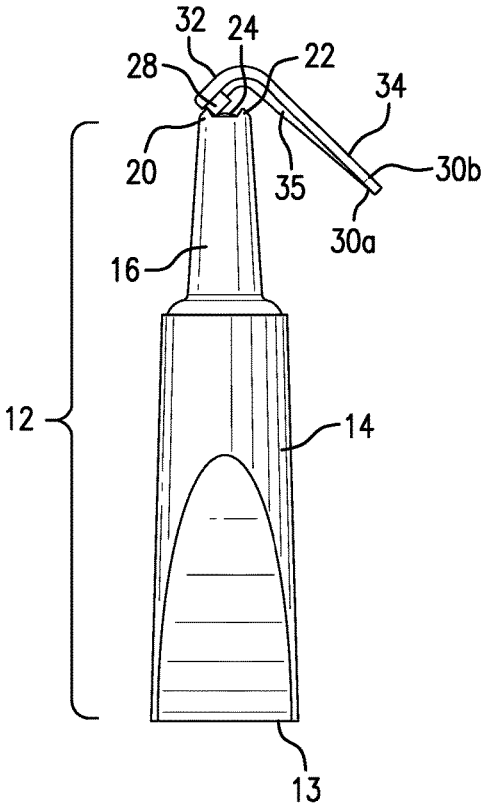
Figure 16:
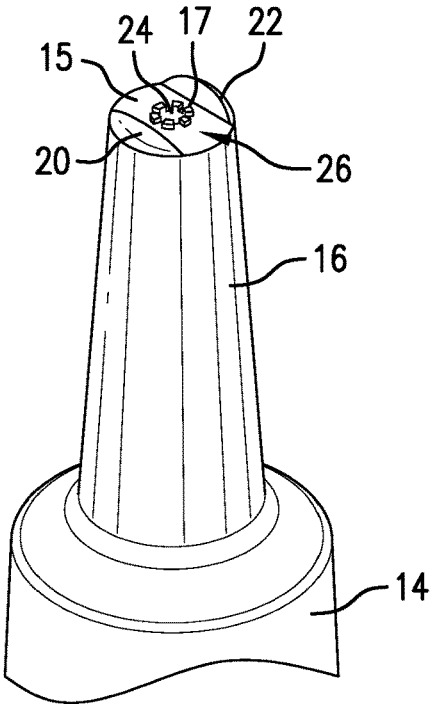
FIG. 16 is a partial perspective view of the applicator with the cap removed.
Figure 17:
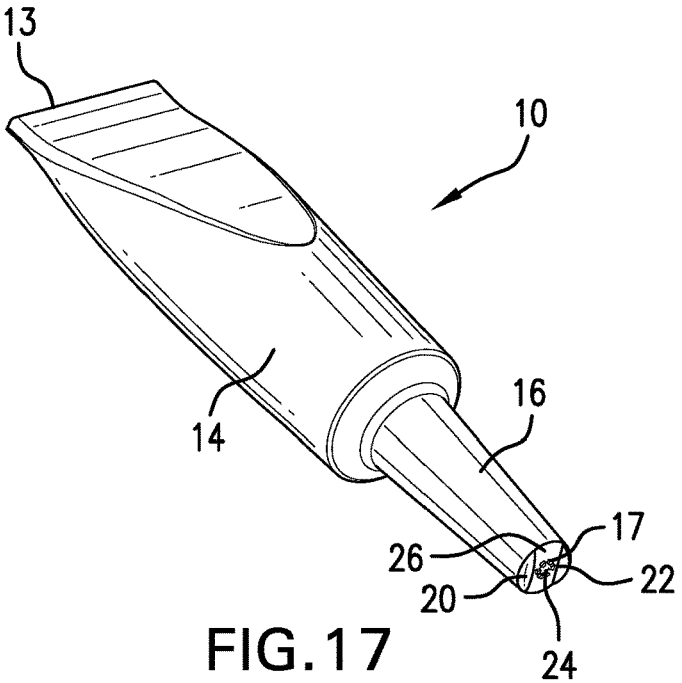
FIG. 17 is a perspective view of the applicator tube with the cap removed.
Figure 18:
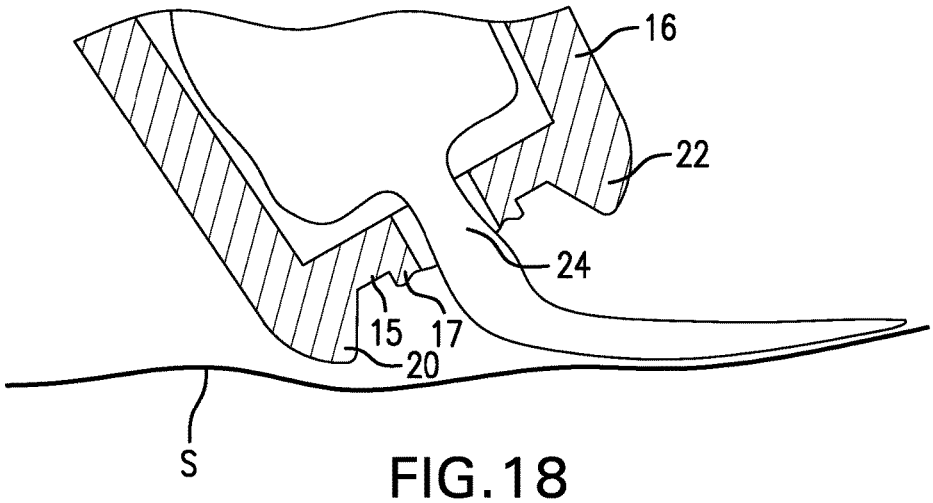
FIG. 18 is a partial cross-sectional view of the applicator with the cap removed showing contents housed within the applicator flowing out of the applicator and onto a surface.

As shown, the protrusion 28 is cylindrical. However, the protrusion 28 can take the form of any desired shape. Additionally, as depicted in FIG. 8, the projection 28 includes a recess 31 formed therein that is aligned with the opening 24 in the neck 16. The recess 31 is intended to aid in reducing the surface area at the protrusion 28 and facilitate separation of the protrusion 28 and neck 16, when desired. As depicted in FIG. 8, an outer surface 29 of the protrusion 28 can include a frangible portion 33 defined an undercut, a notch or a channel that extends from an outer periphery of the protrusion 28 toward the opening 24 in the neck 16. The frangible portion 33 is intended to facilitate the separation of the connection between the cap 18 and neck 16 near the opening 24 of the neck 16. Although the frangible portion 33 is depicted in FIGS. 1 and 8 as extending inwardly about the entirety of the outer periphery of the protrusion 28 of the cap 18, the configuration should not be limiting in scope as the frangible portion can take any form and be located at any point about the cap 18 and/or the neck 16. For example, as shown in FIG. 9, at least one frangible portion 33*a* can extend inwardly from a location about the outer surface of the protrusion 28*a* of the cap 18*a*, near the outer surface of the distal end 15*a* of the neck 14*a*. As depicted in an embodiment in FIG. 10, at least one frangible portion defined by an undercut 33*b* can extend from an inner surface 27*b* of the protrusion 28*b* toward an outer surface of the protrusion 28*b*. As depicted in an embodiment in FIGS. 11 and 12, at least one frangible portion defined by a channel 33*c* can be spaced from the protrusion 28*c* and extend from the outer surface of the distal end 15*c* of the neck 14*c* toward a cavity with the neck 14*c*. As can be seen in an embodiment in FIG. 13, at least one frangible portion defined by an undercut 33*d* can extend at least partially about the outer surface of the protrusion 28*d* toward the opening 24*d* in the neck 14*d* and at least one frangible portion defined by a channel 33*dd* can extend from the outer surface of the distal end 15*d* of the neck 14*d* toward the cavity 11*d* within the neck 14*d* at least partially about the protrusion 28*d*.

When an individual desires to remove the cap 18 from the reservoir body 12 as shown in FIGS. 14A through 15B, the individual can grasp the reservoir body 12 in an upright position with one hand and grip the second leg 34 of the cap 18 and permanently separate the cap 18 away from the neck 16 by applying a torque to the second leg 34. Upon an application of torque to separate the cap 18 from the reservoir body 12, the protrusion 28 of the cap 18 will separate from the neck 14 at about the frangible portion 33, exposing the opening 24 in the neck 16 (See FIGS. 16 and 17) to allow the contents housed therein to be dispensed therefrom. To apply the contents (e.g., fluid) onto a surface (e.g., the skin of an animal) (See FIG. 18), the individual can then rotate the applicator assembly 10 and directly apply the shroud against the surface, allowing the contents to flow into the channel 26 and onto the surface S while the rough surface 17 formed about the opening 24 is prevented from contacting the surface S.

Figure 19:
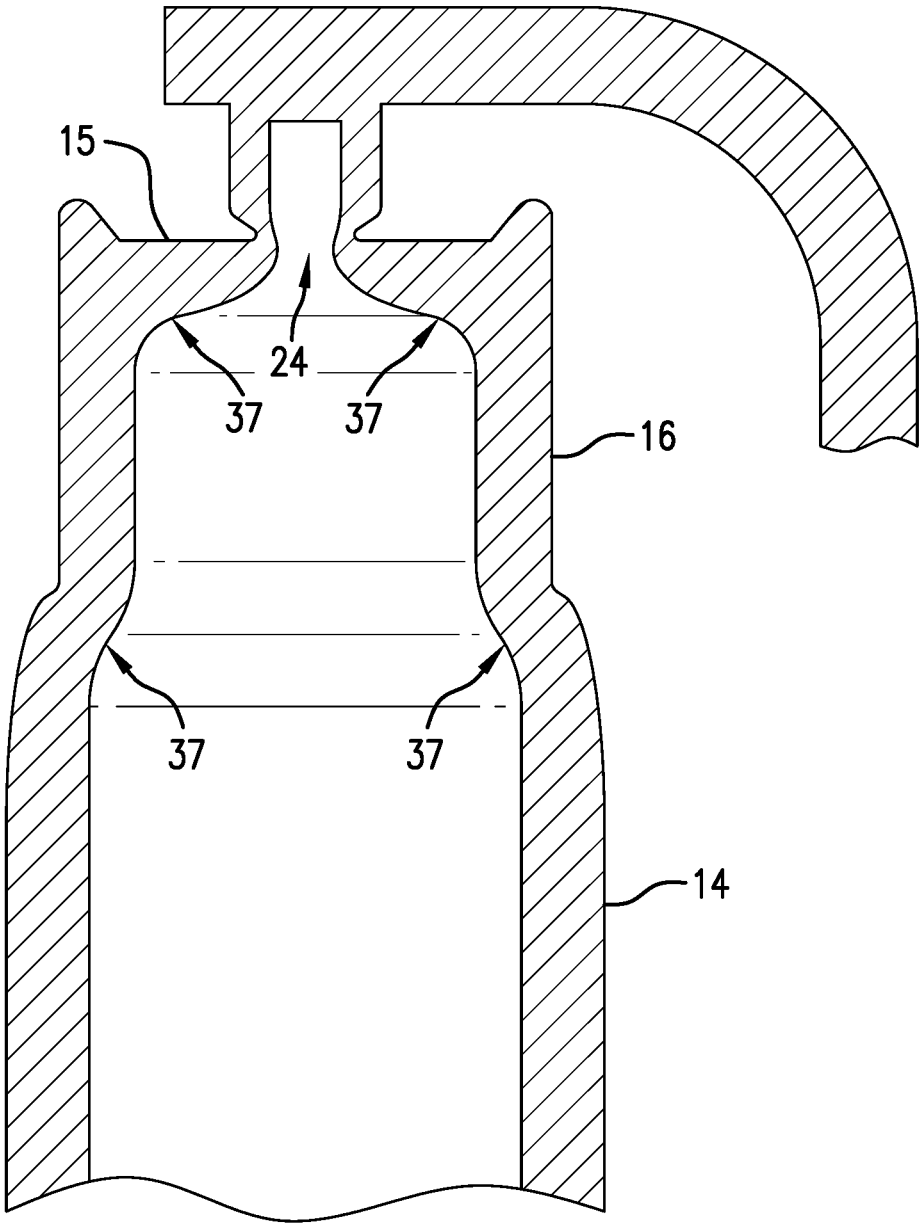
FIG. 19 is a cross-sectional view of an embodiment of the internal cavity of the applicator assembly.

As depicted in an embodiment in FIG. 19, the internal sidewalls 37 of the housing 14 and neck can be angled toward the distal end 15 of the neck 16 to aid in disbursement of the contents housed in the reservoir body 12 and ensure at most minimal retention of said contents in the reservoir body 12.

The foregoing description and accompanying drawings illustrate principles, exemplary embodiments, and modes of operation of the present invention. However, the present invention should not be construed as being limited to the particular embodiments disclosed herein. Variations to the embodiments discussed above will be appreciated by those skilled in the art without departing from the scope of the invention. Accordingly, the above-described embodiments and accompanying drawings should be regarded as illustrative rather than restrictive.

What is claimed is:

1. An applicator assembly, comprising:

a reservoir body;

a neck extending from the reservoir body and including an exposable opening at a distal end thereof and a shroud, which is comprised of a plurality of protrusions that are entirely independent of each other and spaced from each other such that a gap between each of the protrusions exists, extending at the distal end about the exposable opening; and a cap in fluid communication with and releasably fixed to the distal end of the neck, fully encompassing the exposable opening in the neck and sealing the reservoir body.

2. The applicator assembly of claim 1, wherein the reservoir body, the neck and the cap area are a single element.

3. The applicator assembly of claim 1, wherein the cap includes a protrusion that extends from the neck.

4. The applicator assembly of claim 1, wherein the cap includes a projection that extends from the neck and a handle that extends, at least in part, at an angle from the projection.

5. The applicator assembly of claim 4, wherein the handle is a one-piece element that includes a first arm that extends substantially traverse to and from the projection and a second arm that extends at an angle from the first arm along the neck toward the reservoir body.

6. The applicator assembly of claim 5, wherein the second arm of the handle extends at an angle of about 90 degrees from the first projection.

7. The applicator assembly of claim 4, wherein the handle is spaced from an extends along at least a portion of the neck and includes a first surface, a second surface and a rib extending substantially along the second surface and facing at least a portion of an outer surface of the neck.

8. The applicator assembly of claim 4, wherein the handle is substantially L-shaped.

9. The applicator assembly of claim 1, wherein the cap includes a projection that extends from the neck and the projection includes an internal cavity that is aligned with the opening in the neck.

10. The applicator assembly of claim 1, wherein the cap includes a projection that extends from the neck and the projection includes at least one frangible portion that extends inwardly from an outer periphery of the projection to aid in facilitating separation of the cap from the neck at a specific location to uncover the exposable opening and minimize fragmentation when removing the cap.

11. The applicator assembly of claim 10, wherein the at least one frangible portion extends at least partially about the outer periphery of the projection.

12. The applicator assembly of claim 10, wherein the at least one frangible portion extends about an entirety of the outer periphery of the projection.

13. The applicator assembly of claim 10, wherein the at least one frangible portion extends at an angle from the outer periphery of the projection.

14. The applicator assembly of claim 10, wherein a plurality of the at least one frangible portion extends about the outer periphery of the projection.

15. The applicator assembly of claim 10, wherein the at least one frangible portion extends about the outer periphery of the projection adjacent an outer surface of the neck to ensure separation of the cap when removed at about the distal end of the neck.

16. The applicator assembly of claim 10, wherein the projection includes a sidewall having a first surface and a second surface that is spaced from the first surface and substantially aligned with the exposable opening and the at least frangible portion extends inwardly from the first surface toward the second surface to facilitate separation of the cap from the neck.

17. The applicator assembly of claim 10, wherein the neck includes the at least one frangible portion that extends from an outer surface at a distal end of the neck toward an inner cavity of the neck and about the exposable opening.

18. The applicator assembly of claim 10, wherein the neck includes the at least one frangible portion that extends from an outer surface at a distal end of the neck toward an inner cavity of the neck and about the exposable opening and the projection includes at least one frangible portion that extends inwardly from an outer surface of the projection, adjacent the distal end of the neck, to facilitate separation of the cap from the neck.

19. The applicator assembly of claim 1, wherein the shroud includes a first protrusion that extends from a first portion of an outer periphery of the neck and a second protrusion that is spaced at least by the opening in the neck from the first protrusion, that extends at a second portion of an outer periphery of the neck such that the first protrusion and the second protrusion form a recessed channel at the opening to aid in dispensing the contents housed within the reservoir body and the neck when the neck is in direct contact with a surface.

20. The applicator assembly of claim 1, wherein the applicator assembly is comprised entirely from a polymeric material.

21. The applicator assembly of claim 1, wherein an external surface of at least the reservoir body includes a non-slip coating.

22. The applicator assembly of claim 1, wherein at least the reservoir body is comprised of a flexible material.

23. A method of forming an applicator, the method comprising the following steps:

molding the applicator as a single element that includes a reservoir body, a neck that extends from a first end of the reservoir body and includes an exposable opening at a distal end thereof and a shroud, which is comprised of a plurality of protrusions that are entirely independent of each other and spaced from each other such that a gap between each of the protrusions exists, extending at the distal end about the exposable opening and a cap that integrally formed with and releasably fixed to the distal end of the neck, fully encompassing the exposable opening in the neck and sealing the reservoir body;

filling the applicator with a fluid; and sealing a second end of the reservoir body.

24. The method of claim 23, wherein the cap is comprised of a projection that, in an assembled state, is in fluid communication with the neck and encompasses the opening in the neck, a handle that includes a first arm extending substantially transverse to and from the projection and a second arm extending at an angle from the first projection along the neck.

25. A method of using an applicator, the method comprising:

providing an applicator that includes a reservoir body, a neck that extends from the reservoir body and includes an opening at a distal end thereof and a shroud, which is comprised of a plurality of protrusions that are entirely independent of each other and spaced from each other such that a gap between each of the protrusions exists, extending at the distal end about the opening and a cap that is integrally formed with and releasably fixed to the distal end of the neck, fully encompassing the opening in the neck and sealing the reservoir body;

holding the reservoir body with a first hand;

gripping the cap with a second hand; and separating the cap from the neck of the applicator.

26. The method of claim 25, wherein the cap is separated from the neck by at least one of rotation, levering and pulling.

27. The method of claim 25, further comprising the step of gripping the second arm and at least one of lifting, pulling and rotating the second arm away from the neck to remove the cap from the applicator and at least one of rotating, twisting and pulling the cap to remove the cap from the applicator.

28. The method of claim 27, further comprising the step of contacting the tip of the applicator with a surface wherein the protrusions aid in allowing contents housed within the applicator to be released from the applicator and flow onto the surface.

29. An applicator assembly, comprising:

a reservoir body;

a neck extending from the reservoir body and including an end wall having an outer surface and an inner surface with the outer surface delimiting the neck at a distal end thereof, an exposable opening extending through the end wall and a shroud, which is comprised of a plurality of protrusions that are independent of each other and spaced from each other such that a gap between each of the protrusions exists, extending at the distal end of the neck about the exposable opening; and a cap in fluid communication with and releasably fixed to the end wall of the neck, fully encompassing the exposable opening in the neck and sealing the reservoir body, the cap including a projection that extends directly from the end wall and that includes at least one frangible portion that extends about an outer periphery of the projection directly adjacent the outer surface of the end wall of the neck to ensure separation of the cap when removed at about the distal end of the neck.

30. An applicator assembly, comprising:

a reservoir body;

a neck extending from the reservoir body and including an exposable opening at a distal end thereof and a shroud, which is comprised of a plurality of protrusions that are independent of each other and spaced from each other such that a gap between each of the protrusions exists, extending at the distal end about the exposable opening; and a cap in fluid communication with and releasably fixed to the distal end of the neck, fully encompassing the exposable opening in the neck and sealing the reservoir body, the cap including a projection that is delimited between a first end and a second end and that extends from the neck at the first end thereof and a one-piece handle that has a first arm that is fixed directly to and extends traverse to the second end of the projection and a second arm that extends untethered at an angle from the first arm toward the reservoir body.

* * * * *